US005644898A

United States Patent [19]

Shepherd et al.

[11] Patent Number: 5,644,898

[45] Date of Patent: Jul. 8, 1997

[54] GLASS PACKAGING SYSTEM AND METHOD

[75] Inventors: Stuart Craig Shepherd, Brampton, Canada; Thomas Carl Zito, Maineville, Ohio

[73] Assignee: FANUC Robotics North America, Inc., Auburn Hills, Mich.

[21] Appl. No.: 500,662

[22] Filed: Jul. 11, 1995

[51] Int. Cl.[6] ..... B65B 35/50

[52] U.S. Cl. ..... 53/445; 53/447; 53/155; 53/540; 414/789.5

[58] Field of Search ..... 53/445, 447, 474, 53/155, 540, 542; 414/789.5

[56] References Cited

U.S. PATENT DOCUMENTS

| | | | |
|---|---|---|---|
| 2,372,982 | 4/1945 | Richards et al. . | |
| 2,487,255 | 11/1949 | Mahoney . | |
| 2,540,996 | 2/1951 | Ryden . | |
| 2,634,216 | 4/1953 | Pineles et al. . | |
| 3,385,462 | 5/1968 | Deldime et al. | 53/447 |
| 3,583,932 | 6/1971 | Benton et al. . | |
| 4,136,141 | 1/1979 | Bauer et al. | 53/474 X |
| 4,200,670 | 4/1980 | Albach . | |
| 4,489,106 | 12/1984 | Duffer et al. . | |
| 4,859,714 | 8/1989 | Locke et al. . | |
| 4,897,276 | 1/1990 | Locke et al. . | |
| 5,079,269 | 1/1992 | Locke et al. . | |
| 5,236,728 | 8/1993 | Locke et al. . | |
| 5,247,747 | 9/1993 | Grey et al. | 53/474 X |
| 5,404,692 | 4/1995 | Locke et al. . | |

FOREIGN PATENT DOCUMENTS

| | | | |
|---|---|---|---|
| 489658 | 6/1992 | European Pat. Off. | 53/447 |

*Primary Examiner*—Linda Johnson
*Attorney, Agent, or Firm*—Howard & Howard

[57] ABSTRACT

A system and method for packaging a plurality of substantially rigid sheet-like members. The system includes apparatus for carrying out the method steps of applying a liquified material to a selected location on a surface of each of the plurality of sheet-like members, cooling the liquified material to form a removable solid element adhering to the selected location on the surface, and stacking the plurality of sheet-like members for packaging such that the solid elements act as interleaving spacers therebetween protecting the sheet-like members from handling and shipping damage.

22 Claims, 2 Drawing Sheets

GLASS PACKAGING SYSTEM AND METHOD

TECHNICAL FIELD

This invention relates to a cold setting foam-in-place system and method for glass packaging.

BACKGROUND ART

Due to the fragile nature of glass, glass manufacturers must invest considerable resources in both labor and materials to adequately protect flat glass assemblies, windshields and similar products. In that regard, glass packaging must be designed to protect the glass from damage that may be caused by piece to piece contact, as well as by handling and shipping.

More specifically, complex glass shapes or assemblies require the use of interleaves or sleeves constructed from styrofoam, cardboard or craft paper to separate the individual glass assemblies, thereby preventing scratching or other damage. The glass and packing materials are then securely loaded into wooden or cardboard crates or steel racks for shipping purposes.

Such glass packaging systems and methods, however, suffer from a number of problems. First, most such materials used for glass packaging must be custom die-cut, thereby increasing packaging costs. Moreover, due to high disposal costs, such materials require significant storage space between uses. That storage must also be closely controlled, since such materials fail to provide adequate protection to the glass if they are exposed to moisture and/or other contaminants.

Further, to ensure damage free shipment, prior art packaging materials tend to be overused, again raising costs. Such materials are also not amenable to use in automated glass packaging. As a result, complex glass assemblies must be manually packed and un-packed, yet again contributing to higher costs as well as increasing the risk of damage to the glass and injury to workers.

Some of these problems have been overcome by the application of various types of thin coatings to the glass assemblies, as disclosed in U.S. Pat. Nos. 4,200,670 and 3,583,932. However, such coatings can be difficult to remove and are not typically re-usable. Moreover, since the entire surface of the glass assembly must be treated, such coatings can also be costly. Most importantly, however, such thin coatings do not properly protect complex shapes which are not or cannot be packed in tight surface-to-surface contact. This is especially true at key interference points between assemblies, such as corners and/or edges.

As a result, there exists a need for an improved glass packaging system and method. Such a system and method would use an interleaving material that could be applied only to those areas of a glass assembly requiring protection, thereby saving material and optimizing protection. The interleaving material for such a system and method would be moisture resistant, easily re-usable and compact to save storage space and/or reduce or eliminate disposal problems. Such a system and method would also be amenable to automation using commercially available, proven equipment for highly reliable and simple operation.

DISCLOSURE OF INVENTION

Accordingly, it is the principle object of the present invention to provide an improved system and method for glass packaging.

According to the present invention, then, a method and system are provided for packaging a plurality of substantially rigid sheet-like members such as glass or the like. The method comprises applying a liquified material to a selected location on a surface of each of the plurality of sheet-like members, and cooling the liquified material to form a removable solid element adhering to the selected location on the surface. The method further comprises stacking the plurality of sheet-like members for packaging such that the solid elements act as interleaving spacers therebetween protecting the sheet-like members from handling and shipping damage.

The system of the present invention comprises means for applying a liquified material to a selected location on a surface of each of the plurality of sheet-like members, and means for cooling the liquified material to form a removable solid element adhering to the selected location on the surface. The system further comprises means for stacking the plurality of sheet-like members for packaging such that the solid elements act as interleaving spacers therebetween protecting the sheet-like members from handling and shipping damage.

These and other objects, features and advantages will be readily apparent upon consideration of the following detailed description in conjunction with the accompanying drawings.

BEST MODE FOR CARRYING OUT THE INVENTION

Figure 1:
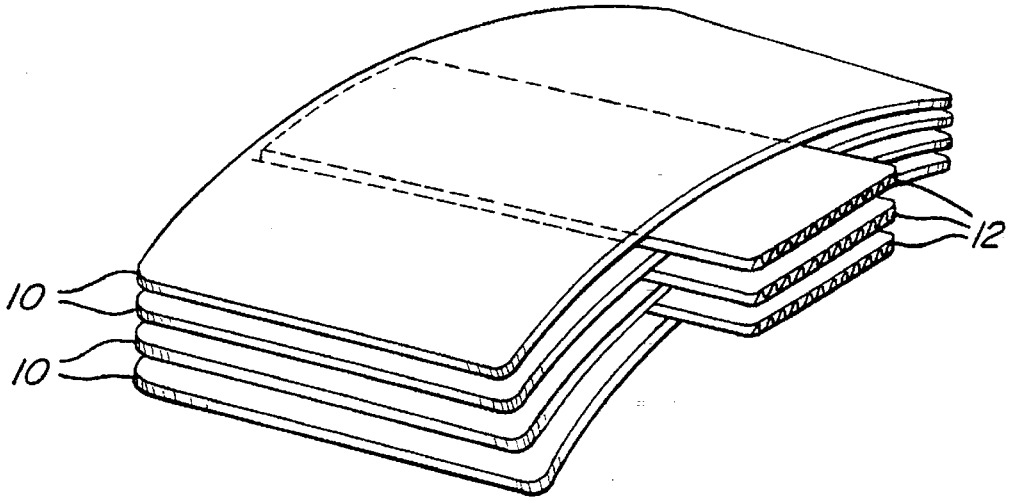
FIG 1 PRIOR ART
FIG. 1 is a perspective view of glass packaging according to a prior art system and method.

Referring first to FIG. 1, a perspective view of glass packaging according to a prior art system and method is shown. As seen therein, a plurality of glass automotive windshields 10 are stacked for packaging and shipment using a plurality of interleaving spacers 12 which, as previously stated, are typically constructed from styrofoam, cardboard, or craft paper. While typically packaged vertically, the glass windshields 10 are illustrated herein horizontally for convenience.

Spacers 12 generally extend along and contact only the mid-portion of the glass windshields 10 and provide little support or protection along the edges thereof. As previously discussed, spacers 12 also suffer from a number of other problems including those related to storage, disposal and moisture/contaminant exposure.

Figure 2:
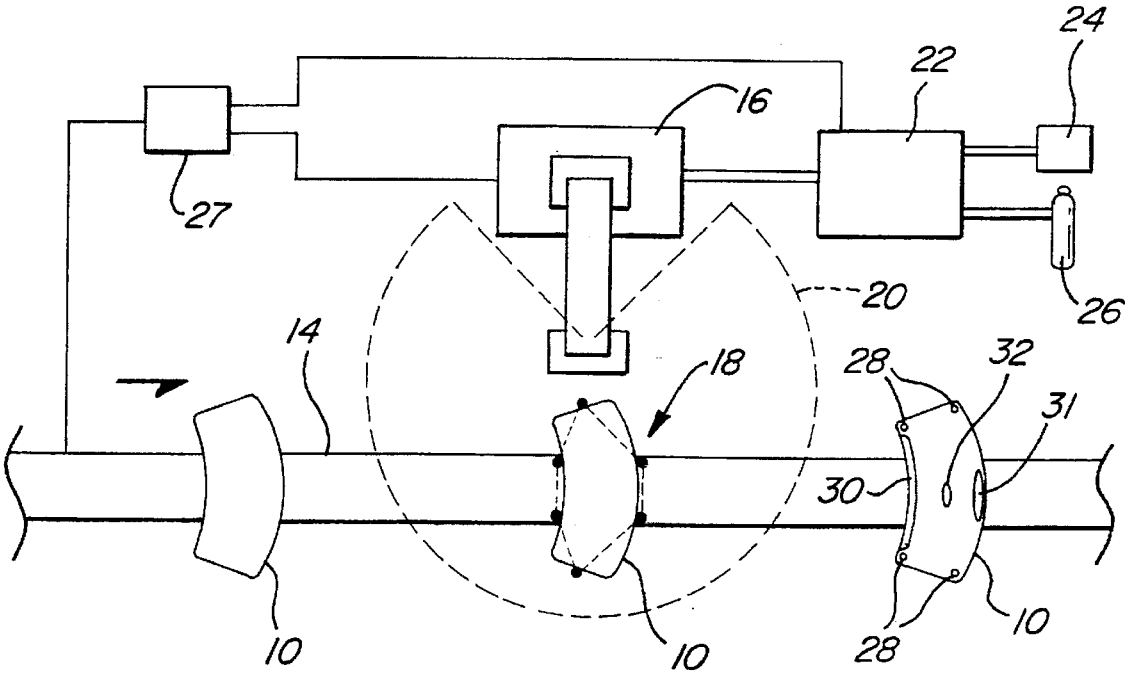
FIG. 2 is a simplified block diagram of the glass packaging system of the present invention.

Referring next to FIG. 2, a simplified block diagram of the glass packaging system of the present invention is shown. As seen therein, a glass windshield 10 is transported via a conventional glass handling conveyor system 14 to a work position immediately adjacent a programmable robot 16. Robot 16 is preferably a four or six axis version, and may be floor or overhead mounted as desired.

A glass squaring fixture 18 positions glass windshield 10 within the work cell 20 of robot 16, thereby allowing for repeatable operations. Alternatively, squaring fixture 18 may be replaced or augmented with sensors or an optical vision system for further flexibility at reduced cost.

It should also be noted that, for simplicity, only a "stop-and-go" version of the glass system and method of the present invention will be described. Nevertheless, the system and method may also be implemented to allow continuous movement of glass windshields 10 through the robotic work cell 20 by using a combination of robot integrated vision systems, switches, and conveyor position encoders, thereby allowing robot 16 to track the glass windshields 10.

Still referring to FIG. 2, a delivery system 22 next provides a liquified protective material to robot 16 for application to the surface of glass windshield 10. In that regard, a base material 24 is loaded into a delivery system 22 reservoir in solid form, such as chips or pellets. Delivery system 22 melts base material 24 and constantly pumps it to robot 16.

Delivery system 22 also preferably injects the liquified base material 24 with a gas 26, such as nitrogen, so that the liquified material ultimately applied to the surface of glass windshield 10 is a foam-like substance. The foam-like substance and the base material 24 from which it is derived are easily liquified and applied in controlled patterns via commercially available equipment. In that regard, the thickness, resiliency and density of the foam-like substance is selectable and can be controlled via the programmable robot 16 and a controller 27 (discussed in greater detail below), such as by varying the pressure of the gas 26 injected into base material 24.

The foam-like substance and the base material 24 from which it is derived also have a liquid temperature sufficiently low that the foam-like substance will not stress the glass windshield 10 upon application thereto. The foam-like substance is further designed to cool and set within a matter of seconds in ambient air. In is solid form, the foam-like substance is also moisture-resistant and easily removable from the surface of the glass windshield 10. While the foam-like substance and the base material 24 from which it is derived may be a plastic, they are preferably a biodegradable substance for cost-effective disposal. Complete descriptions of the foam-like substance are provided in U.S. Pat. Nos. 4,859,714; 4,897,276; 5,079,269; 5,236,728; and 5,404,692 which are incorporated herein by reference.

Referring still to FIG. 2, robot 16 is also provided in electrical communication with a controller 27 for directing the application of the liquified material onto the surface of the glass windshield 10. Controller 27 is similarly provided in electrical communication with delivery system 22 and glass conveyor system 14 for overall control of the glass packaging system and method of the present invention.

It should also be noted that robot 16 includes conventional dispensing equipment (not shown) for applying the liquified material onto the surface of the glass windshield 10. More specifically, robot 16 is provided with a dispensing nozzle, as well as suitably heated feed lines to maintain the liquid nature of the protective material to the point of its application upon the surface of the glass windshields 10.

According to the direction of controller 27, robot 16 may apply the liquified material to the surface of glass windshield 10 in any number of programmed selected locations and/or patterns, depending upon the specific configuration of the particular glass windshield 10 or similar glass assembly. Preferably, robot 16 at least applies the liquified material in spot patterns 28 at the corners of glass windshield 10, as well as in a strip pattern 30 along that edge of glass windshield 10 which will ultimately be oriented along the bottom of a shipping crate or rack. As will be discussed in greater detail below, such locations on the surface of glass windshield 10 are selected to optimize the protection afforded to the glass windshield 10 by the protective material during stacking, packaging and shipping/handling thereof.

However, robot 16 may also apply the liquified material to any number of other locations on the surface of glass windshield 10. For example, robot 16 may apply the liquified material in a strip pattern 31 along any other edge or edges of glass windshield 10, or in a spot pattern 32 in the mid-portion of glass windshield 10.

Upon completion of the application process, glass windshield 10 is transported by glass conveyor system 14 away from robot 16. During such transport, the liquified material previously applied to the surface of glass windshield cools and sets in the ambient air, thereby adhering to that surface to form at least one removable solid element. As will be discussed in greater detail below, upon subsequent stacking of glass windshields 10, such solid elements function as interleaving spacers therebetween for protection thereof during handling and shipping. In that regard, the base material 24 and resultant foam-like substance are preferably chosen such that they cool quickly in ambient air so that the glass windshields 10 may be packaged shortly after treatment.

Figure 3:
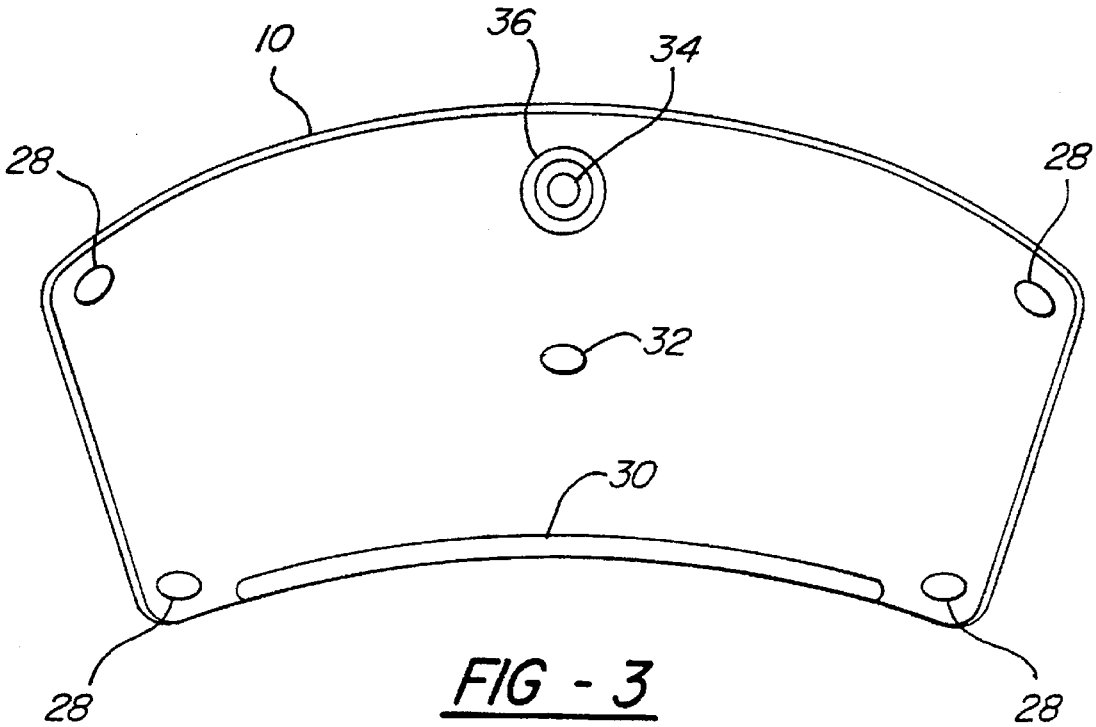
FIG. 3 is a side view of the interior surface of a glass automobile windshield treated for packaging according to the system and method of the present invention.

Referring next to FIG. 3, a side view of the interior surface of a glass automobile windshield 10 treated for packaging according to the system and method of the present invention is shown. As seen therein, the liquified material described above has been applied at selected locations on the surface of glass windshield 10 and cooled to form solid elements. More specifically, spot patterns 28 and 32 of the material have been applied to the corners and center of glass windshield 10. Additionally, a strip pattern 30 has been applied along the bottom edge of glass windshield 10. As also seen in FIG. 3, a mirror bracket 34 secured to the surface of glass windshield 10 near the top edge thereof is surrounded by a circular strip pattern 36 of the material.

Figure 4:
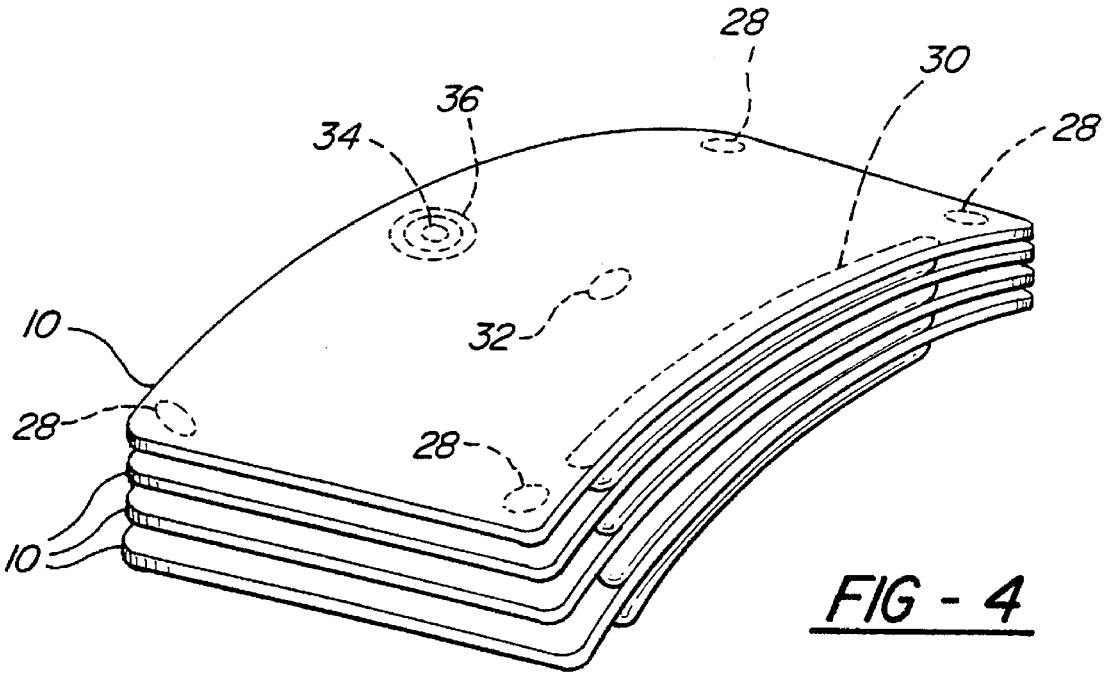
FIG. 4 is a perspective view of glass packaging according to the system and method of the present invention.

Referring finally to FIG. 4, a perspective view of glass packaging according to the system and method of the present invention is shown. As seen therein, spot patterns 28 and 32, and strip patterns 30 and 36 of the cold-set solid elements act as interleaving spacers between a plurality of glass windshields 10, replacing interleaving spacers 12 as shown in FIG. 1. In addition to supporting and protecting glass windshields 10 along the mid-portions thereof, such interleaving spacers also provide protection at the corners of glass windshields 10.

Moreover, by being strategically placed at selected locations on glass windshields 10 requiring protection, spot patterns 28 and 32, and strip patterns 30 and 36 of the cold-set solid elements optimize protection of glass windshields 10 without requiring coating or treatment of the entire surface thereof. As is also apparent from FIG. 4 in comparison to FIG. 1, such interleaving spacers allow for a greater number of glass windshields 10 to be packed per unit volume. In that regard, while typically packaged vertically, glass windshields 10 are again illustrated herein horizontally for convenience.

Finally, since such interleaving spacers adhere to the surface of glass windshields 10, the glass packaging system and method of the present invention also allows for automated stacking and packing thereof. Upon reaching their final destination, the glass windshields 10 packaged according to the system and method of the present invention may be easily unpacked via an automated process similar to that used for packing and stacking. The interleaving spacers may also be easily removed for storage and re-use. In that regard, the spacers may be ground for compact storage in the form of solid base material chips or pellets. Alternatively, the spacers may also be cost-effectively disposed given their preferably bio-degradable nature.

As is readily apparent from the foregoing description, then, the present invention provides an improved system and method for glass packaging. More specifically, the present invention provides a glass packaging system and method using interleaving spacers that are applied only to those areas of a glass assembly requiring protection, thereby saving material and optimizing protection. The interleaving spacers of the glass packaging system and method of the present invention are also moisture resistant, easily re-usable and compact to save storage space and/or reduce or eliminate disposal problems. Moreover, the glass packaging system and method of the present invention is also automated using commercially available, proven equipment for highly reliable and simple operation.

The system and method of the present invention have been described in conjunction with the packaging of glass windshields 10 or similar glass assemblies. It is to be understood, however, that the system and method of the present invention may be utilized for packaging any type of substantially rigid sheet-like member, such as sheet metal or the like.

In that same regard, it is also to be understood that the present invention has been described in an illustrative manner and the terminology which has been used is intended to be in the nature of words of description rather than of limitation. As previously stated, many modifications and variations of the present invention are possible in light of the above teachings. Therefore, it is also to be understood that, within the scope of the following claims, the invention may be practiced otherwise than as specifically described.

We claim:

1. A method for preparing a plurality of substantially rigid sheet-like members for packaging, the method comprising:

a. applying a liquified material to a plurality of selected locations on a surface of a first sheet-like member;

b. cooling the liquified material to form a removable solid element adhering to each of the selected locations on the surface; and c. stacking a second sheet-like member against the first sheet-like member for packaging such that the solid elements act as interleaving spacers therebetween protecting the sheet-like members from handling and shipping damage.

2. The method according to claim 1 wherein said step a. comprises:

identifying a portion of the surface of the first sheet-like member requiring protection as the selected location; and providing an applicator for dispensing the liquified material onto the selected location.

3. The method according to claim 1 wherein said step a. includes providing a programmable material dispensing robot for dispensing the liquified material onto the selected location.

4. The method according to claim 1 wherein said step b. comprises exposing the liquified material to ambient air for a selected period of time.

5. The method according to claim 1 wherein the solid elements are moisture resistant.

6. The method according to claim 1 wherein the solid elements are bio-degradable.

7. The method according to claim 1 wherein the liquified material is a plastic material.

8. The method according to claim 1 wherein the liquified material is formed as a foam.

9. The method according to claim 8 wherein the foam has selectable thickness and density properties.

10. The method according to claim 1 wherein the sheet-like members are glass sheets.

11. The method according to claim 1 including repeating said steps a. through c. for a plurality of sheet-like members in sequence.

12. The method according to claim 1 including performing said steps a. and b. for a plurality of sheet-like members and then performing said step c. for the plurality of sheet-like members.

13. The method according to claim 1 wherein the solid elements are removable from the surface of each of the sheet-like members and are formed of a material which can be converted to pellet-like particles for forming the liquified material.

14. A system for preparing a plurality of substantially rigid sheet-like members for packaging comprising:

means for transporting each of a plurality of sheet-like members to a work position;

means for applying a liquified material to a selected location on a surface of each of the plurality of sheet-like members at said work position; and means for cooling said liquified material to form a removable solid element adhering to said selected location on said surface whereby said solid elements act as interleaving spacers between adjacent ones of said sheet-like members when stacked together protecting said sheet-like members from handling and shipping damage.

15. The system according to claim 14 wherein said means for transporting is a conveyor.

16. The system according to claim 15 wherein said means for cooling is said conveyor transporting the sheet-like members away from said means for applying and exposing said liquified material to ambient air for a selected period of time.

17. The system according to claim 14 wherein said means for applying said liquified material includes means for identifying a portion of said surface of said sheet-like members requiring protection as said selected location and means for dispensing said liquified material onto said selected location.

18. The system according to claim 14 wherein said means for applying said liquified material includes a programmable material dispensing robot.

19. The system according to claim 14 wherein said liquified material is a plastic material.

20. The system according to claim 14 wherein said liquified material is formed of a foam having selectable thickness and density properties.

21. The system according to claim 14 wherein said solid elements are removable from said surface of each of said sheet-like members and are formed of a material which can be converted into pellet-like particles for forming the liquified material.

22. The system according to claim 14 wherein said plurality of sheet-like members are glass sheets.

* * * * *